United States Patent [19]

Kaieda et al.

[11] Patent Number: 4,958,194

[45] Date of Patent: Sep. 18, 1990

[54] TRANSFERRING DEVICE AND AN IMAGE FORMING APPARATUS

[75] Inventors: Shozo Kaieda, Hachioji; Hideo Okajima, Tama, both of Japan

[73] Assignee: Kentek Information Systems, Inc., Allendale, N.J.

[21] Appl. No.: 316,511

[22] Filed: Feb. 28, 1989

[30] Foreign Application Priority Data

Jan. 12, 1989 [JP] Japan ..... 1-32811

[51] Int. Cl.[5] ..... G03G 15/14

[52] U.S. Cl. ..... 355/277; 355/311

[58] Field of Search ..... 355/217, 221, 225, 273, 355/274, 277, 265, 313, 311

[56] References Cited

U.S. PATENT DOCUMENTS

| | | | |
|---|---|---|---|
| Re. 30,535 | 3/1981 | Kuroishi et al. | 355/265 |
| 3,996,466 | 12/1976 | Davis | 355/274 X |
| 4,114,536 | 9/1978 | Kaneko et al. | 355/277 |
| 4,213,693 | 7/1980 | Imai et al. | 355/265 |
| 4,563,076 | 1/1986 | Takahashi et al. | 355/221 X |

*Primary Examiner*—Fred L. Braun
*Assistant Examiner*—Sandra L. Hoffman
*Attorney, Agent, or Firm*—Marmorek, Guttman & Rubenstein

[57] ABSTRACT

A transferring device for transferring on a record paper a toner image formed onto an image forming member is disclosed. The transferring device comprises a transfer belt with a dielectric layer formed on a conduction belt member; a driving device for running the transfer belt; a transfer roller for contacting the transfer belt to an image forming member with pressure; a corona charges arranged at a position opposite to the transfer belt for charging the transfer belt with a charge having a polarity opposite to the charging polarity of the toner; a grid electrode arranged between the corona charger and the transfer belt; a plurality of bias sources connected to the grid electrode for biassing the grid electrode at respective potentials; and a change-over circuit for changing over the connection between the grid electrode and the bias source, whereby the grid potentials are selectively changed over in accordance with the characteristics of a record paper to be used.

8 Claims, 4 Drawing Sheets

TRANSFERRING DEVICE AND AN IMAGE FORMING APPARATUS

BACKGROUND OF THE INVENTION

The present invention relates to a transferring device for transferring on a record paper a toner image formed onto an image forming member, such as a photosensitive drum and an image forming apparatus utilizing such a transferring device.

In an image forming apparatus, such as an electrophotographic printing apparatus or a copying device, an electrostatic latent image is formed onto a photosensitive member or body, the electrostatic latent image is developed to make a toner image, the toner image is transferred onto a recording medium, such as, a record paper and the transferred image is subjected to a fixing step to form a hard copy. Various kinds of transferring devices for transferring the toner image formed onto the photosensitive body are well known, for example, the belt transferring device disclosed in Japanese Patent Application Laid-open No. 61-117583. In this known belt transferring device, a transfer belt formed by a dielectric material is stretched between two drive rollers, the transfer belt is charged at a uniform potential by a corona charger, the record paper carried in synchronism is electrostaticaly attracted onto the transfer belt, and then a toner image transfer process is performed while carrying the record paper under the state of holding it to the transfer belt. After transferring the toner image onto the record paper, charges on the surface of the transfer belt are uniformly removed by a charge remover which is composed of a high A.C. supply source and a corona charger and then the transfer belt stands by for next transferring step. That is, the transfer belt is subjected to a charge removing process before every charging to decrease the potential of the transfer belt surface to a given surface potential, after which the transfer belt is again subjected to a charging process to always make the potential of the transfer belt a given certain surface potential.

In the known belt transferring device, the record paper is carried under the state of holding it on the transfer belt and a toner image is transferred onto the record paper with the use of charges on the transfer belt, so that the carrying and the transferring for the record paper may be performed with high reliability.

In order to record an image having uniform image density on the record paper, it is always necessary to hold the charging potential of the transfer belt at a certain potential. Therefore, in the conventional belt transferring device, an A.C. charge remover is arranged between the transferring position and the charging position of the transfer belt, and then once the potential of the transfer belt surface is decreased to a given potential by the A.C. charge remover, the transfer belt surface is again charged to a certain potential. In order to perform A.C. charge removing, it is necessary to provide a high A.C. supply source and a corona charger, so that manufacturing cost becomes high and the construction becomes complicated.

Also, a copying machine and a printing apparatus of duplex type have been put into pratical use which are capable of recording image on both a surface and a back surface of the record paper. In this image forming device of duplex type, toner image transferred on one surface of the record paper is fixed with a heat fixing device such as heat roll fixing device, and then the record paper is turned upside down so as to transfer a toner image on the back surface of the record paper. When the record paper passes through the heat fixing device, however, the percentage of moisture content of the record paper becomes decreased substantially, so that the electrostatic capacity becomes remarkably small. Therefore, in an image forming device using the conventional transferring device, when the image recording is performed on the back surface of the record paper, an electric field caused between a photosensitive drum and the record paper at transferring and for effecting the transfer becomes decreased substantially so that the transferring efficiency becomes decreased greatly. Thus the image density also becomes decreased, thereby causing a decrease of image quality, or a generation of edging phenomenon.

The record paper has large hygroscopic property so that the percentage of moisture content of the record paper is largely changed under the ambient environment.

More particularly, the specific resistance of the record paper becomes greatly decreased under high humidity, and thus the transferring efficiency becomes decreased, resulting in a decrease of image density.

The image recording is also performed on record papers having various different thicknesses. In this case the distance between the transfer belt surface and the photosensitive drum surface is changed in accordance with the thickness of the record paper to be used so that field intensity for attracting the toner image to the record paper is changed depending on whether thick record paper or thin record paper is used, thereby decreasing the transfer efficiency in case of recording the image on the thick record paper, resulting in a decrease of image density.

SUMMARY OF THE INVENTION

It is an object of the present invention to eliminate the above described disadvantages of the conventional transferring device.

It is another object of the present invention to provide a transferring device having simple construction and capable of always holding the transfer potential at a certain potential without utilizing high A.C. supply source, as well as capable of always obtaining desired transfer efficiency even though the properties of record paper to be used, such as the percentage of moisture content, the specific resistance and thickness or the like of record paper is changed.

It is a further object of the present invention to provide a recording image having high image density and sharpness without causing a decrease image quality, or a generation of edging phenomenon.

According to the present invention, there is provided a transferring device comprising a transfer belt with a dielectric layer formed on a conduction belt member; a driving means for running the transfer belt; a transfer roller for contacting the transfer belt to an image forming member with pressure; a corona charger arranged opposite to the transfer belt for charging the transfer belt with a charge having a polarity opposite to charging polarity of toner; a grid electrode arranged between the corona charger and the transfer belt; a plurality of bias sources connected to the grid electrode for biasing the grid electrode at respective potentials; and a change-over circuit for changing over the connection between the grid electrode and the bias source, whereby the grid potentials are selectively changed over in accordance with the characteristics of a record paper to be used.

According to the present invention, there is also provided an image forming apparatus of a duplex type capable of first performing an image recording on one recording surface of the record paper and then an image recording on the other recording surface of the record paper, the apparatus comprising an image forming member; a transfer belt arranged at a location opposite to the image forming member and having a dielectric layer formed on a conductive belt member; a driving means for running the transfer belt at the same speed as the peripheral speed of the image forming member; a transfer roller for contacting the transfer belt to the image forming member with pressure; a corona charger arranged opposite to the transfer belt for charging the transfer belt with charge having a polarity opposite to charging polarity of toner; a grid electrode arranged between the corona charger and the transfer belt; first and second bias sources connected to the grid electrode for biasing the grid electrode at given potentials; and a change-over circuit for changing over the connection between the grid electrode and the bias source; whereby the change-over circuit connects the first bias source to the grid electrode in case of recording an image on the one recording surface of the record paper, and connects the second bias source having a biasing voltage larger than that of the first bias source to the grid electrode in case of recording an image on the other recording surface of the record paper.

In the belt transferring device for transferring the toner image formed on the photosensitive member onto the record paper with the use of charges on the transfer belt, the amount of charges on the transfer belt is limited, so that the effective transfer field formed between the surface of the record paper and the surface of the photosensitive member is largely changed by means of electrostatic capacity of the record paper lying between the transfer belt and the surface of the photosensitive member. That is if the percentage of moisture content of the record paper becomes decreased or the thickness of the record paper becomes increased, the voltage assigned to the record paper becomes increased and thus the effective transferring field becomes decreased. In this case, if the surface potential of the transfer belt is always set high, the deterioration of the transfer belt is promoted due to electrical stress. According to the present invention, therefore, the surface potential of the transfer belt is selectively set in accordance with the property of the record paper to be used, such as the percentage of moisture content, the thickness or the like of the record paper. If high surface potential is set for the transfer belt, the effective transferring field formed between the surface of the photosensitive member and the surface of the record paper becomes also increased in accordance with the increase of surface potential so that a substantially large effective transferring field may be obtained even though the percentage of moisture content of the record paper becomes decreased and the thickness thereof becomes increased, thereby providing a sharp image with high image density. If common image recording is performed on the record paper, the surface potential of the transfer belt is set comparatively low. In this manner, a sharp image may always be reproduced and the lifetime of the transfer belt may be more prolonged. To this end, according to the present invention, a mesh-like grid electrode is provided between the corona charger and the transfer belt, a plurality of bias sources are connected to the grid electrode and the grid potentials are changed-over in accordance with the property of record paper to be used, so that the potential of transfer belt may be set at the transfer potential in accordance with the property of the record paper to be used by means of change-over of the grid potential. Even though the percentage of moisture content and the thickness of the record paper are changed, the surface potential of the transfer belt may also be changed-over, thereby reproducing sharp image with high image density on the record paper.

When the present invention is applied to the image forming apparatus of duplex type for perferming the image recording on both surfaces of the record paper, the surface potantial of the transfer belt is automatically set higher in case of recording or copying images on the back surface of the record paper, so that images having good image density may be reproduced on both surfaces of the record paper.

BRIEF DESCRIPTION OF THE DRAWINGS

The invention will now be described in more detail, by way of example, with reference to the accompanying drawings, in which.

DETAILED EXPLANATION OF THE PREFERRED EMBODIMENT

Figure 1:
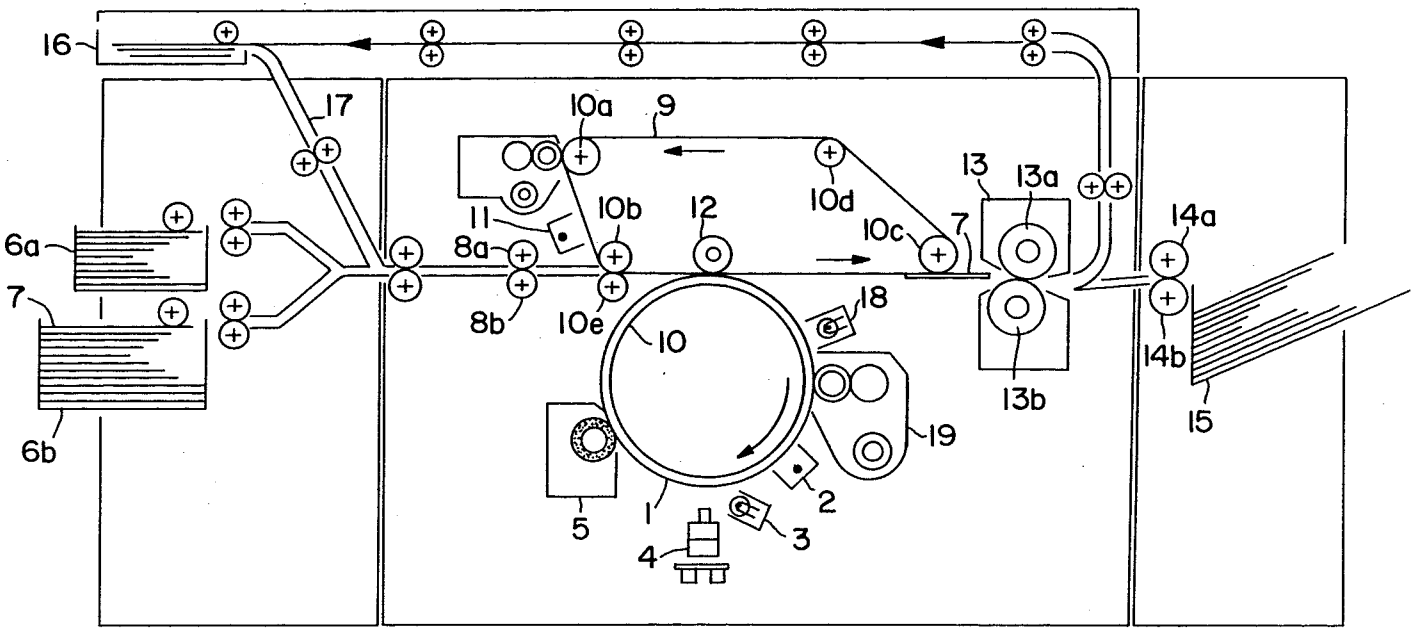
FIG. 1 is a diagram showing the construction of one embodiment of an image forming apparatus according to the present invention.

Now to the drawings, there is shown one embodiment of an image forming apparatus according to the present invention. In this embodiment, a printing apparatus of duplex type is described. In this embodiment, as an image forming member, a photosensitive drum 1 is used which comprises a photosensitive layer formed on an outer perpheral surface of a base drum composed of aluminum (Al). The outer peripheral surface of the photosensitive drum 1 is uniformly charged by a corona charger 2 with positive charges over the whole surface thereof, after which auxiliary illuminating light from an auxiliary light source 3 and illuminating light from a printing head 4 are irradiated on the drum 1 to form a latent image. The auxiliary light source 3 irradiates uniformly the whole surface of the photosensitive drum 1. The printing head 4 is constituted by an LED array formed by arranging for example a plurality of light emitting elements in a straight line over the width of the image to be recorded. This LED array 4 is irradiated according to the image signal supplied from the image forming device and a very small spot of irradiated light focused by a SELFOC (trade name) lens is illuminated onto the photosensitive drum 1. The latent image formed by the illuminated light from the auxiliary light source 3 and the LED array 4, is developed by a developing device 5, to form a toner image. In this case, the positive charged toner is used to effect reverse development. A record paper 7 is supplied from feeding cassette **6*a* or 6*b* in synchronization with the photosensitive drum 1. The record paper 7 is taken out one by one from a cut sheet feeder by means of feeding rollers, carried by carrying rollers, and carried to a transferring position subject to proper timings for synchronization with rotation of the photosensitive drum 1 by a pair of registering rollers 8a and 8b. A transfer belt 9 is arranged so as to face the photosensitive drum 1. The transfer belt 9 is composed of a conductive plastic sheet having an insulating dielectric layer thereon and is stretched between four rollers 10a, 10b, 10c and 10d with a capability of running. This transfer belt 9 is run at the same speed as the running speed and in the same direction as the running direction of the photosensitive drum 1 and is charged with a polarity opposite to the charging polarity of toner by means of the corona charger 11. The record paper 7 carried therein in synchronization with the rotation of the photosensitive drum 1 is contacted to the transfer belt 9 through a pair of rollers 10b and 10e, electrostatically attracted thereto and carried to a transfer position in accordance with the transfer belt. At this transfer position, a transfer roller 12 composed of an elastic and conductive rubber roller is arranged at the rear side of the transfer belt. The transfer belt 9 and the record paper 7 are lightly depressed onto the surface of the photosensitive drum 1 with the use of elastic force. When the record paper 7 is contacted onto the surface of the photosensitive drum, the electric field formed by charges on the surface of the transfer belt transfers the toner particles present on the surface of the photosensitive drum onto the record paper. After transferring of the toner particles the record paper 7 is carried by electrostatic attraction onto the surface of the transfer belt and separated at the position of the roller 10c and then entered into a heat roll fixing device 13, in which the toner particles are fixed onto the record paper. After the fixing of the toner particles, the record paper 7 is delivered to a delivery stacker 15 face down by carrier rollers 13a, 13b and delivery rollers 14a, 14b. If images are to be recorded on the back surface of the record paper, the record paper 7 is carried upwards by a paper passing route changing mechanism (not shown) after passing through the fixing device 13 and delivered to an intermediate tray 16 through a carrying route positioned the upper side of the apparatus by means of few pairs of carrying rollers. In this case the copied surface of the record paper on which images are recorded is now located on the upper side. The record paper 7 is then carried through a passing route 17 by means of a switching back mechanism (not shown) in accordance with a back surface copying instruction from the printer, and once again carried to the transfer position under the state of holding it to the transfer belt after taking account of the synchronous timing by the registering rollers 8a, 8b. After transfer on the back surface, the record paper 7 is delivered to a delivering cassette 15 through the fixing device 13. After the transfer process, the charges on the photosensitive drum 1 are removed uniformly by a charge removing device 18 such as a lamp so that the surface potential of the photosensitive drum is decreased to the residual potential. The residual toner particles on the photosensitive drum 1, are then removed by means of a brush cleaning device 19, and then the photosensitive drum 1, is again charged by the corona charger 2** over the whole surface thereof so as to form next latent image.

Figure 2:
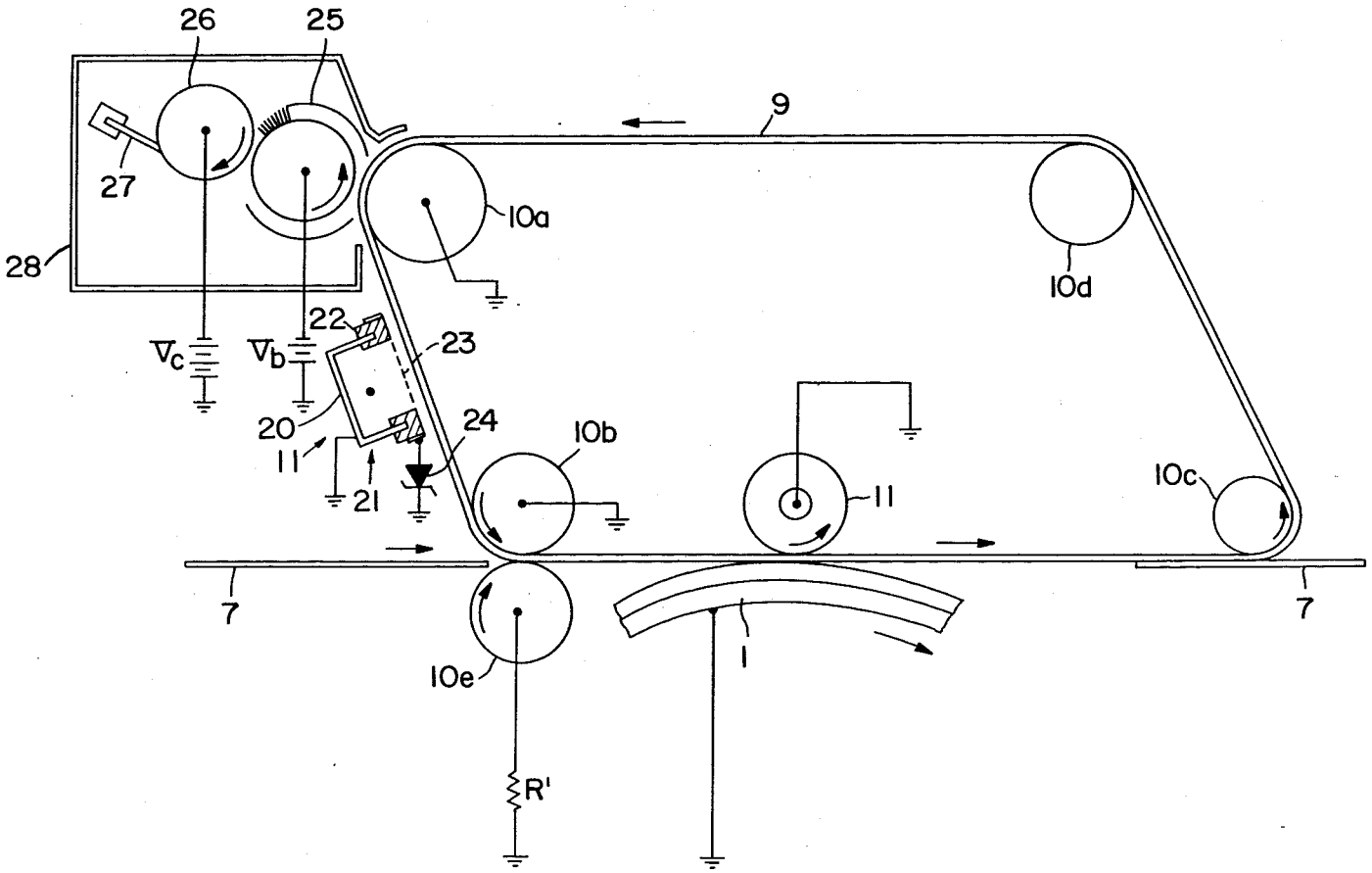
FIG. 2 is a diagram showing the construction of one embodiment of a transferring device according to the present invention.

FIG. 2 shows a detailed construction of the transferring device according to the present invention. The transfer belt 9 comprises a conduction belt member formed by inpregnating a conductive material such as carbon with plastic material. The conductive belt member has an outer peripheral surface which is coated by a dielectric layer to form an endless belt. The transfer belt 9 has the dielectric layer which is positioned to face the photosensitive drum 1. The transfer belt 9 is charged over its surface with the surface potential of, for example, 1100 V by means of the charging device 11 which comprises a corona charger 21 having a corona wire connected to a shield casing 20 and a high D.C. supply source (not shown) and a mesh-shaped grid electrode 23 attached to the shield casing 20 through an insulative supporting member 22. The grid electrode 23 is connected to a Zener diode 24 serving as a bias source. When corona ions having a polarity opposite to the charging polarity of toner are released from the corona charger 20, a part of said ions arrive at the surface of the transfer belt 9 after passing through openings of the mesh-shaped grid electrode 23, and another part of the corona ions are captured by the grid electrode 23 and thus the charges thereof flow to the ground through the Zener diode 24. As a result of this, the grid electrode 23 is in the self biased state and thus the grid electrode 23 is biased at breakdown voltage of the Zener diode 24 due to constant-voltage thereof. If the grid electrode 23 is arranged near the surface of the transfer belt 9, the transfer belt 9 is charged at the voltage equal to the grid voltage, since the Zener diode 24 serves as a bias source of the grid electrode. Even though, for example, the transfer belt 9 passes by the front surface of the charging device 11, or after passing through the transferring position the surface potential of the transfer belt is charged or the surface potential is changed partly, the surface of the transfer belt is charged at the set potential only after passing through the charging device. Moreover, the surface potential of the transfer belt may be controlled adequately by controlling the bias voltage of the grid electrode. The transfer belt which is charged at a given surface potential, for example 1100 V is run to the position of the pair of rollers 10b, 10e and then the record paper 7 is electrostatically attracted by these rollers. That is, the record paper 7 is entered between the roller 10b and the back-up roller 10e and, the depressed force effected between the rollers 10b and 10e makes the record paper and the transfer belt closely contacted, thereby utilizing the electrostatic attraction advantageously. In this case when the back-up roller 10e is in the electrically floating state the induction of charges on the record paper becomes insufficient. In the present embodiment, therefore, the back-up roller 10e is composed of conductive elastic rubber and is connected to a grounded point through a resistor R. In this manner, when the back-up roller 10e is constituted by a conductive elastic rubber roller and is connected to the grounded point, charges may simultaneously be injected into the record paper from the back-up roller, at the same time the record paper is contacted closely to the transfer belt, so that the record paper may be electrostatically attracted to the transfer belt effectively. The record paper 7 electrostatically attracted to the transfer belt 9 is carried under the state of holding it to the transfer belt, and the toner image on the photosensitive drum is transferred on the record paper at the position opposite to the photosensitive drum 1 by means of an electric field due to the charges on the transfer belt, and then the record paper 7 is separated from the transfer belt at the position of the roller 10e. After separation of the record paper, the transfer belt 9 is run at the cleaning position through the roller 10*d*. In this embodiment, toner and dust adhered to the surface of the transfer belt, are removed by a brush roller 25. This brush roller 25 comprises conductive elastic fibers which are composed of rayon or regenerated cellulosic fibers and nylon fibers impregated with conductive materials. These conductive elastic fibers are studded onto the outer periphery surface of the brush roller 25. This brush roller 25 is so arranged as to contact with the transfer belt 9, and is rotatably and journally supported by an insulative bearing which is connected to a drive motor (not shown), so as to rotate in a direction opposite to the running direction of the transfer belt. Moreover, the brush roller 25 is connected through a flange to a bias source $V_b$ of about $-300$ V having a polarity opposite to the charging polarity of toner. A metal recovery or collection roller 26 is arranged so as to contact the brush roller 25 at a position opposite thereto. This recovery roller 26 is rotatably and journally supported through the insulative bearing and connected to a negative bias source $V_c$. This bias source $V_c$ has the same polarity as that of a bias source $V_b$ for the brush roller and is set to a voltage larger than that of the bias voltage $V_b$, that is, about $-600$ V. The recovery or collection roller 26 rotates in the same direction as that of the brush roller 25 and has a pheripheral speed $v_c$ which is set larger than the peripheral speed $v_b$ of the brush roller 25, that is $v_c > v_b$. The collection roller 26 is provided with a scraper 27 made of urethane rubber or thin metal arranged so as to touch roller 26, thereby scraping off the toners or the like adhered onto the outer peripheral surface of the collection roller 26. Toners and dust adhered onto the surface of the transfer belt are mechanically swept away therefrom by the brush roller 25 to clean the surface of the transfer belt. In this case the brush roller 25 is biased at about $-300$ V, so that the toners or dust thus scraped off are attracted to the brush roller 25. Toners or dust thus attracted thereto are carried to the position opposite to the collection roller 26 and are attracted electrostatically to the collection roller 26 by the bias voltage applied thereto, so that these toners and dust are scraped off by the scraper 27 and deposited on the bottom surface of a housing 28.

Figure 3:
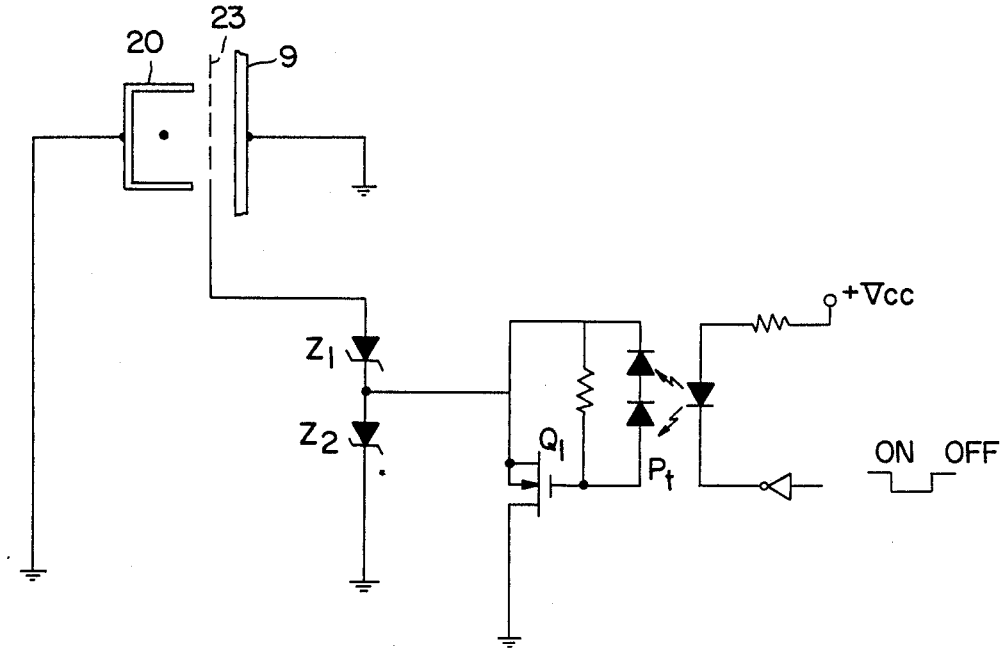
FIG. 3 is a circuit diagram showing the construction of the bias circuit.

FIG. 3 is a circuit diagram showing the construction of one embodiment of a biasing circuit for the grid electrode. As described above, in the image forming apparatus of duplex type, after the record paper is passed through the heat roll fixing device, the image is recorded on the back surface of the record paper, so that the percentage of moisture content of the record paper is substantially decreased for recording the image on the back surface of the record paper. The electrostatic capacity thereof becomes decreased, resulting in an insufficient field intensity for attracting the toner particles to back surface of the record paper. According to the present invention, the surface potential of the transfer belt may be changed from the case of recording the image on the front surface (first recording surface) of the record paper to the case of recording the image on the back surface (second recording surface) of the record paper. Specifically, the surface potential is made larger for the case of recording the image on the back surface of the record paper in comparison to the case of recording the image on the surface thereof. That is, the surface potential of the transfer belt may be set at $-1100$ V in the case of recording the image on the first recording side of the record paper and set at $-1400$ V in the case of recording the image on the second recording side of the record paper. To this end, as shown in FIG. 3, first Zener diode $Z_1$ having breakdown voltage of $-1200$ V and second Zener diode $Z_2$ having breakdown voltage of $-300$ V are connected in series to the grid electrode 23, and the cathode electrode of the second Zener diode $Z_2$ is grounded. The junction point of the two Zener diodes $Z_1$ and $Z_2$ is connected to a source electrode of a field effect transistor $Q_1$, and a drain electrode thereof is grounded. A gate electrode of the transistor $Q_1$ is connected to one end of a parallel combination of a resistor R and a photo diode of a light coupling element $P_t$. The other end of the parallel combination is connected to a source electrode of the transistor $Q_1$. The anode electrode of a light emitting diode of the light coupling element $P_t$ is connected to a reference potential $V_{cc}$ through the resistor $R_1$, and the cathode electrode of the light emitting diode is connected to a drive element $Q_2$ for the light emitting diode. In the case of recording the image on the first recording side of the record paper, the light coupling element $P_t$ is driven to render the transistor $Q_1$ conductive. When the transistor $Q_1$ is in the conducting state, the current flows in the grid electrode 23 through the first Zener diode $Z_1$ and the field effect transistor $Q_1$, so that the grid electrode 23 is biased at the breakdown voltage of the first Zener diode $Z_1$, that is, at $-1200$ V, and thus is always set at the surface potential of $-1100$ V. In the case of recording the image on the second recording side of the record paper, the light coupling element is held in an OFF state, so that the field effect transistor $Q_1$ becomes non-conductive and thus the current flows in the grid electrode 23 flow in the ground through two Zener diodes $Z_1$ and $Z_2$. Therefore, the grid electrode 23 is biased at $-1500$ V and thus the surface of the transfer belt is charged at $-1400$ V. In this manner, if the image is recorded on the second recording surface side of the record paper, when the surface potential of the transfer belt is set higher in the negative direction than the case of recording the image on the first recording surface side thereof the field strength for attracting toner particles on the photosensitive drum 1 to the record paper becomes larger in accordance with the increase of the surface potential even though the electrostatic capacity of the record paper becomes small, resulting in an increase of transfer efficiency.

Figure 4:
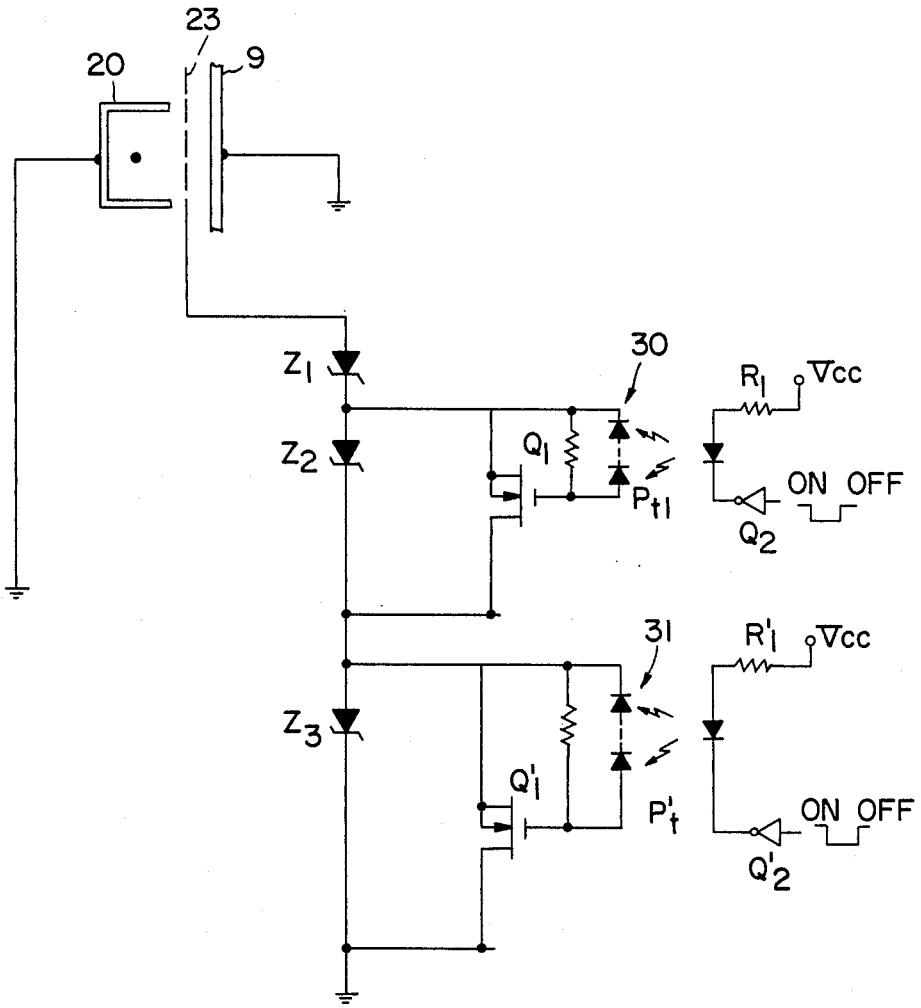
FIG. 4 is a circuit diagram showing the construction of a modification of the bias circuit.

FIG. 4 is a circuit diagram showing a modification of the bias circuit. In this embodiment, a series combination of three Zener diodes $Z_1 \sim Z_3$ is connected to the grid electrode 23 to form four kinds of bias sources. First change-over circuit 30 is connected in parallel to the Zener diode $Z_2$ and second change-over circuit 31 is connected in parallel to the Zener diode $Z_3$. The detaching of the Zener diode $Z_2$ from and to the series combination is made by the first change-over circuit 30 and the detaching of the Zener diode $Z_3$ from and to the series combination is made by the second change-over circuit 31. These change-over circuit 30 and 31 are the same as that shown in FIG. 3, so that the explanation thereof is omitted. In this manner, provided that, for example, the breakdown voltages of the Zener diodes $Z_1 \sim Z_3$ are $-1000$ V, $-200$ V and $-400$ V, respectively, four kinds of bias sources of $-1000$ V, $-1200$ V, $-1400$ V, and $-1600$ V respectively, may be formed, four kinds of grid voltages may be changed-over, in accordance with the properties of the record paper, for example, the thickness and the specific resistance thereof. That is, when record papers having thin, intermediate, thick and high density of large electrostatic capacity are utilized, the transferring is performed at low grid voltage in case of rcording the image on the thin record paper with respect to the record paper having intermediate thickness, and the transferring is performed at higher grid voltage in the negative direction in the case of thick and high density record papers. As a result, the surface potential of the transfer belt may be set at the most suitable value in accordance with the thickness and the electrostatic capacity of the record paper, so that the highest voltage is not always applied to the transfer belt, and thus the lifetime thereof may be prolonged. The percentage of moisture content of the record paper is changed largely under condition of environment, so that use is made of a humidity sensor, and thus the grid voltage may be changed in step-wise manner according to the output of the sensor.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A transfer device for an electrophotographic printing machine, comprising transfer belt means for transferring charged toner from an image forming member to a record paper, means for driving said transfer belt means;

means for pressing said transfer belt means against an image forming member;

corona charging means disposed opposite said transfer belt means for charging said transfer belt means with a charge opposite in polarity to the charge on said toner;

a grid electrode disposed between said corona charging means and said transfer belt means;

a plurality of biasing sources connectable to said grid electrode for biasing said grid electrode at different potentials; and change-over circuit means interconnecting said grid electrode to said plurality of biasing sources for changing the potential at which said grid electrode is biased in dependence upon the characteristics of said record paper.

2. The transfer device of claim 1 wherein said plurality of biasing sources comprises a plurality of voltage regulator diodes connected in series with each other.

3. The transfer device of claim 1 wherein said change-over circuit means comprises a light coupling element and a driving element.

4. The transfer device of claim 1 wherein said means for pressing said transfer belt means against an image forming member comprises a transfer roller.

5. The transfer device of claim 4 wherein said transfer roller is biased to a potential which is opposite to the charge on said toner.

6. The transfer device of claim 1 wherein said transfer belt means comprises a conductive belt and a dielectric layer.

7. An electrophotographic image forming apparatus of the duplex type capable of forming an image on a first recording surface of a record paper, and an image on a second recording surface of said record paper, comprising an image forming member;

transfer belt means disposed opposite said image forming member for transferring charged toner from said image forming member onto said record paper;

means for driving said transfer belt means in synchronization with said image forming member;

means for pressing said transfer belt means against said image forming member;

corona charging means disposed opposite said transfer belt means for charging said transfer belt means with a charge opposite in polarity to the charge on said toner;

a grid electrode disposed between said corona charging means and said transfer belt means;

first and second biasing sources connectable to said grid electrode for biasing said grid electrode at first and second potentials respectively, said second potential being larger in absolute magnitude than said first potential; and change-over circuit means for changing over the connection between said grid electrode and said first and second biasing sources, so that said first biasing source is connected to said grid electrode when said transfer belt means transfers said charged toner onto said first recording surface of said record paper, and so that said second biasing source is connected to said grid electrode when said transfer belt means transfers charged toner onto said second recording surface of record paper.

8. A transfer device for an electrophotographic printing machine, comprising transfer belt means for transferring charged toner from an image forming member onto a record paper;

means for driving said transfer belt means;

means for pressing said transfer belt means against an image forming member;

charging means disposed opposite said transfer belt means for charging said transfer belt with a charge opposite in polarity to the charge on said toner;

a grid electrode disposed between said corona charging means and said transfer belt means; and means for varying the potential at which said grid electrode is biased in dependence upon the characteristics of said record paper.

* * * * *